US006241542B1

(12) United States Patent
Nishide et al.

(10) Patent No.: US 6,241,542 B1
(45) Date of Patent: Jun. 5, 2001

(54) CONNECTOR WITH SHORTING TERMINAL

(75) Inventors: Satoru Nishide; Osamu Ito; Hajime Kawase, all of Yokkaichi; Takahiro Yoneda, Yokohama, all of (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/575,009

(22) Filed: May 19, 2000

(30) Foreign Application Priority Data

May 19, 1999 (JP) ..... 11-138558

(51) Int. Cl.[7] ..... H01R 29/00
(52) U.S. Cl. ..... 439/188; 439/489
(58) Field of Search ..... 439/188, 489, 439/595, 357, 358, 752; 200/51.1

(56) References Cited

U.S. PATENT DOCUMENTS

| | | | | |
|---|---|---|---|---|
| 4,894,019 | | 1/1990 | Howard | 439/188 |
| 5,346,405 | * | 9/1994 | Mosser, III et al. | 439/188 |
| 5,672,073 | | 9/1997 | Matsumura et al. | 439/188 |
| 5,816,834 | | 10/1998 | Nimura et al. | 439/188 |
| 6,036,515 | | 3/2000 | Nakamura | 439/188 |

FOREIGN PATENT DOCUMENTS 0 416 307 3/1991 (EP) .

* cited by examiner

*Primary Examiner*—Paula Bradley
*Assistant Examiner*—Tho D. Ta
(74) *Attorney, Agent, or Firm*—Anthony J. Casella; Gerald E. Hespos; Michael J. Porco

(57) ABSTRACT

A connector is provided to clear a shorted state of a shorting terminal without using a clearing rib. The connector includes female and male housings 10, 20. A slider 40 assembled into the male housing 20 is moved backward by elastic restoring forces of elastically contracted coil springs when female and male housings 10, 20 are properly connected and a locking claw 31 of a lock arm 30 is disengaged from a locking surface 53. By integrally assembling a shorting terminal 60 into the slider 40, the shorting terminal 60 can be moved automatically from a shorting position where contact portions 64 of the shorting terminal 60 are held in contact with male terminal fittings 26 to short them to a clearing position where the contact portions 64 are not in contact with the male terminal fittings 26.

10 Claims, 9 Drawing Sheets

CONNECTOR WITH SHORTING TERMINAL

BACKGROUND OF THE INVENTION

1. Field of the Invention

The present invention relates to a connector provided with a shorting terminal.

2. Description of the Related Art

Japanese Unexamined Patent Publication No. 10-64642 relates to an electrical connector used in an automotive air-bag circuit, and, typical of such prior art connectors, is provided with a shorting terminal. The prior art connector of Japanese Unexamined Patent Publication No. 10-64642 also is illustrated in FIG. 10 of this application. More particularly, the prior art connector of FIG. 10 includes a female housing 1. A plurality of female terminal fittings 2 are accommodated in a side-by-side array in the female housing 1, and a shorting terminal 3 is accommodated in an accommodating chamber 7 in the housing 1. The shorting terminal 3 is held in contact with the female terminal fittings 2 to short them to each other.

A prior art mating male housing 4 is provided with tab-shaped male terminal fittings 5 that are engageable with the female terminal fittings 2. Additionally, the prior art male housing 4 is provided with a shorted state clearing rib 6 that can be inserted between the female terminal fittings 2 and the shorting terminal 3. The shorting terminal 3 shorts the female terminal fittings 2 before the housings 1 and 2 are connected. However the clearing rib 6 is inserted between the shorting terminal 3 and the female terminal fittings 2 and elastically deforms the shorting terminal 3 when the male and female terminal fittings 2 and 5 are connected. As a result the shorted state of the female terminal fittings 2 is cleared.

Since the clearing rib 6 projects from an engaging surface of the male housing 4, it may be struck and broken by external contact. Additionally, the relatively thin width of the clearing rib 6 creates a potential for an error during molding. For example, there have been cases where the plastic material did not sufficiently fill the mold cavity for the thin clearing rib 6. As a result, the clearing rib 6 was not sufficiently long to reach the shorting terminal 3 even when the housings 1, 4 were completely connected with each other. Consequently, the shorted state of the female terminal fittings 2 by the shorting terminal 3 may be not cleared even though the housings 1, 4 are properly connected with each other.

The above-described problem can be avoided by increasing the thickness of the clearing rib 6. However, a larger clearing rib 6 increases the elastic deformation of the shorting terminal 3. Therefore, the height of the accommodating chamber 7 needs to be increased to ensure such an increased degree of deformation, resulting in a larger connector. It has been difficult to deal with this problem.

The present invention was developed in view of the above problems, and an object of the invention is to provide a connector capable of clearing a shorted state of a shorting terminal without using a clearing rib.

SUMMARY OF THE INVENTION

The subject invention is directed to a connector assembly, comprising male and female connector housings that are connectable with each other. One of the connector housings comprises a plurality of terminal fittings and a shorting terminal for shorting the terminal fittings. The shorted state of the terminal fittings is cleared when the male and female connector housings are connected with each other. A movable element is provided integrally with the shorting terminal and is movable between a shorting position where the shorting terminal is in contact with the terminal fittings and a clearing position where the shorting terminal is not in contact with the terminal fittings. The movable element preferably is movable substantially along a connection direction of the connector housings. Additionally, the movable element preferably is provided with a spring means which is contracted elastically to accumulate a biasing force for moving the movable element toward the clearing position when pushed by a pushing portion in the other connector housing. A restricting means may further be provided for substantially constantly holding the movable element in the shorting position. The holding state then may be cleared as the connector housings are connected with each other.

The movable element is held in the shorting position by the restricting means while the connector housings are being connected, even though the pushing portion pushes the spring means. The holding state of the restricting means is cleared when the connector housings are properly connected, and the movable element then is moved to the clearing position by an elastic restoring force of the spring means. As a result, the shorted state of the terminal fittings by the shorting terminal is cleared automatically.

The shorted state of the terminal fittings is cleared by the movement of the movable element in which the shorting terminal is provided. Consequently, it is not necessary to provide the mating connector housing with a shorted state clearing rib. Thus, a variety of problems resulting from the provision of the rib can be avoided. Further, the movable element can be moved automatically to the clearing position as the connector housings are properly connected with each other.

According to a further preferred embodiment, the one connector housing comprises an elastically deformable lock arm for holding the connector housings in locked engagement with each other. The lock arm engages a locking portion in the other connector housing when the connector housings are connected with each other. The lock arm preferably is constructed to hold the movable element in the shorting position by engaging the movable element while the lock arm is elastically deformed and moving over the locking portion. The lock arm is restored to its original shape and engages the locking portion when the connector housings are properly connected with each other. This restoration of the lock arm to its original shape causes the lock arm to disengage from the movable element. Thus, the movable element is made free to move, and is automatically moved to the clearing position by an elastic restoring force of the elastically contracted spring means.

The lock arm preferably is deformable into a deformation permitting space and the movable element preferably is located at least partly in the deformation permitting space when the movable element is in its clearing position. Thus the movable element restricts elastic deformation of the lock arm.

At least one of the lock arm and the locking portion preferably are formed with at least one slanted disengagement portion for assisting the disengagement of the lock arm and the locking portion.

The movable element may be provided with a substantially elastically deformable holding arm. The holding arm engages an engaging portion on the one connector housing when the movable element is in its shorting position. The holding arm is deformed elastically upon contact with a contact portion of the other connector housing, and thus is disengaged from the engaging portion.

The movable element preferably moves automatically from its shorting position, where the shorting terminal shorts the terminal fittings, to the clearing position, where the shorting terminal are not in electrical contact with the terminal fittings, as the connector housings are properly connected with each other.

According to still a further preferred embodiment, the connector housing is shaped such that the movable element can be displaced from its clearing position to its shorting position against the restoring force of the spring means.

Preferably, the connector housing comprises a cutout or window to allow for an operation of the movable element.

These and other objects, features and advantages of the present invention will become apparent upon a reading of the following detailed description and accompanying drawings.

DETAILED DESCRIPTION OF THE PREFERRED EMBODIMENTS

Figure 1:
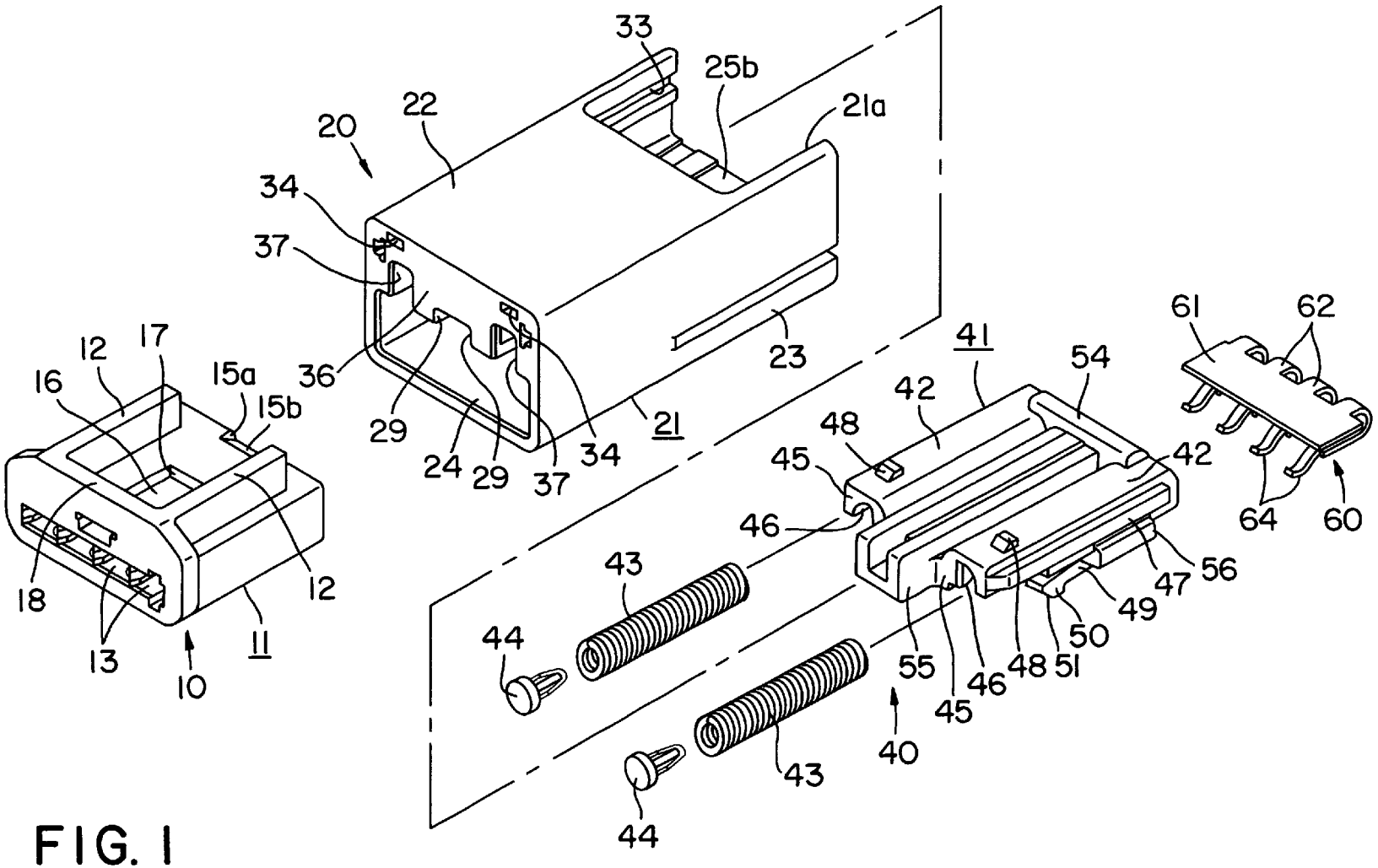
FIG. 1 is an exploded perspective view of a connector according to one embodiment of the invention.

Female and male connector housings in accordance with the subject invention are identified generally by the numerals 10 and 20 respectively in FIG. 1. The housings 10, 20 are made e.g. of a synthetic resin and are at least partly connectable with each other. The sides of the respective housings 10 and 20 that will be engaged with one another will be referred to herein as the front of the respective connector housings 10, 20. A receptacle 22 for accommodating the female housing 10 is provided at the front of the male housing 20, and a slider 40, or movable element, is mountable on a rear part of the male housing 20.

Figure 2:
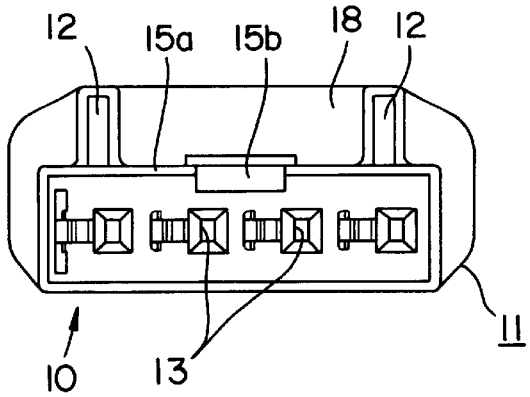
FIG. 2 is a front view of a female housing.
Figure 4:
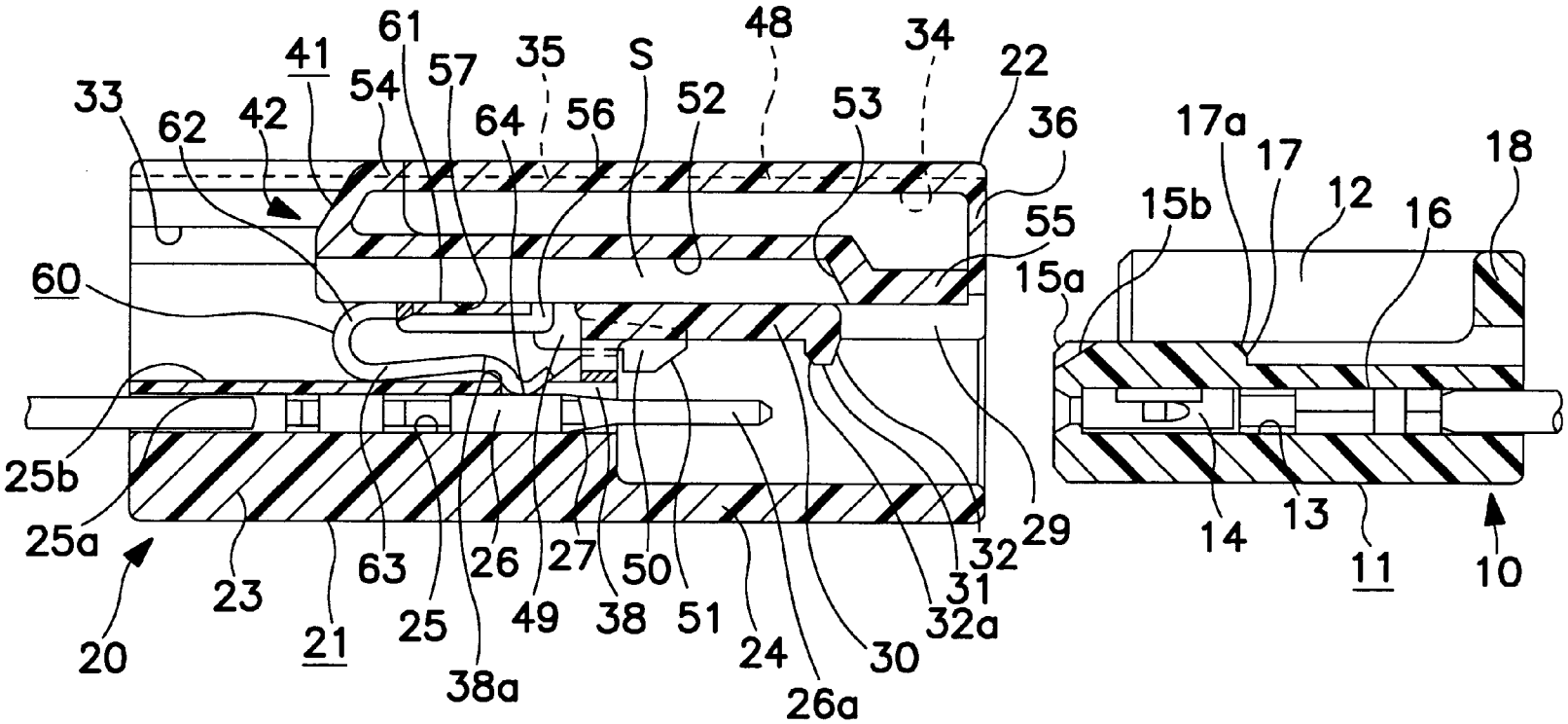
FIG. 4 is a section along line 4—4 of FIG. 3 showing the male and female housings before being connected.

The female housing 10 includes a block-shaped main body 11. The main body 11 is formed with pushing portions 12 that project from positions slightly indented from the front-end surface of the female housing 10 up to the rear end surface thereof. Additionally, the pushing portions 12 are formed on the left and right sides of the upper surface of the main body 11. As shown in FIGS. 1, 2 and 4, cavities 13 are formed substantially side by side along a widthwise direction in the main body 11. Box-shaped female terminal fittings 14 can be accommodated at least partly in the cavities 13 and are locked therein by an unillustrated locking mechanism. The outer edge of the front surface of the female housing 10 preferably is beveled over the entire circumference to form a tapered surface 15*a*. Additionally, the middle of the upper edge of the front-end surface includes a tapered surface 15*b* whose inclination is larger than that of the tapered surface 15*a*. A substantially rectangular recess 16 is formed slightly behind the tapered surface 15*b*, and a front edge of the recess 16 serves as a locking portion 17. An operating portion 18 bulges upward and/or sideways on the rear surface of the female housing 10 and is used to connect and disconnect the housings 10, 20.

The male housing 20 is provided with a main body 21 and a receptacle 22 in the form of a substantially rectangular tube for substantially surrounding the main body 21. The main body 21 is comprised of a terminal-accommodating portion 23 for at least partly accommodating male terminal fittings 26. The main body 21 further comprises an inner tubular portion 24, which is forward of and integral or unitary with the terminal-accommodating portion 23. The inner tubular portion 24 is open at the forward end of the main body 21.

Figure 3:
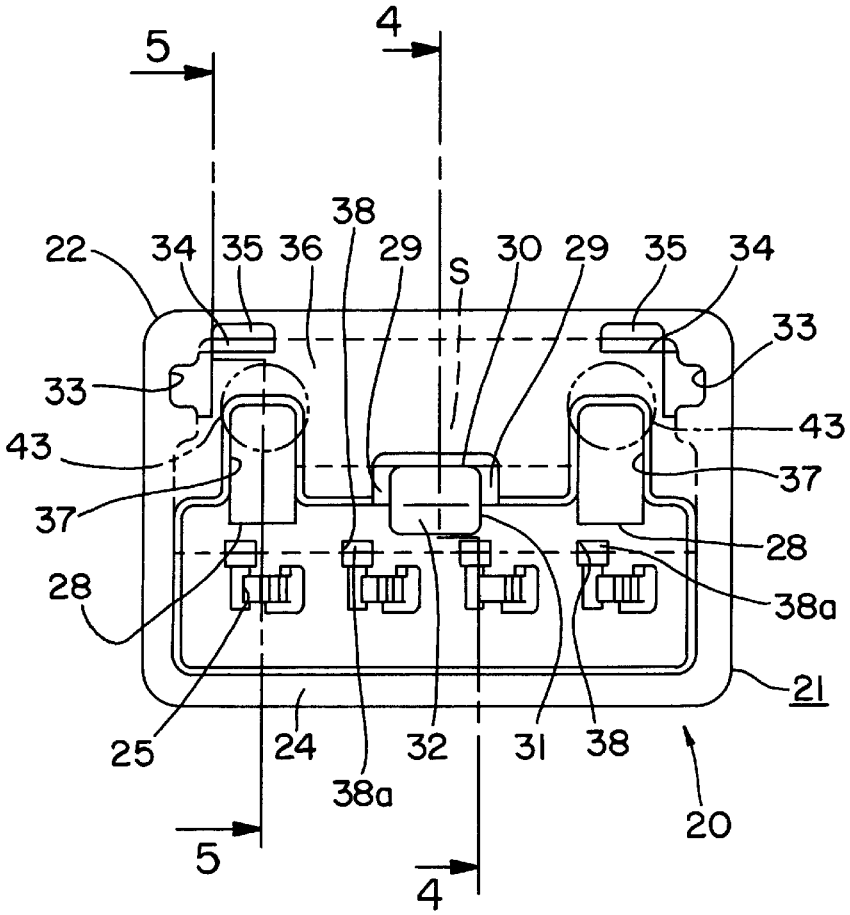
FIG. 3 is a front view of a male housing.

Four cavities 25 are surrounded substantially by surrounding walls 25*a* and are formed substantially side-by-side along a widthwise direction in the terminal accommodating portion 23. The cavities 25 penetrate the terminal-accommodating portion 23 along forward/backward directions, as shown in FIGS. 3 and 4. The cavities 25 at least partly accommodate the corresponding male terminal fittings 26, which are locked by an unillustrated locking mechanism. The front ends of the upper parts of the surrounding walls 25*a* are cut away by a specified width to form exposing portions 38. Thus the male terminal fittings 26 in the cavities 25 are exposed partially to an upper space via the exposing portions 38. Tapered surfaces 38*a* are formed on the rear ends of the exposing portions 38 to enable more efficient deflection of the shorting terminal, as explained further below. Tabs 26*a* of the male terminal fittings 26 project forward into the inner tubular portion 24 from the terminal-accommodating portion 23 for connection with the mating female terminal fittings 14.

A stepped portion 27 is formed between the front end of the terminal-accommodating portion 23 and the upper wall of the inner tubular portion 24. Opposite lateral sides of the stepped portion 27 are formed with a pair of hooking recesses or engaging portions 28. Locking claws 50 of holding arms 49 of the slider 40 can be releasably engaged with the engaging portions 28, as described further below with reference to FIG. 5. An elastically deformable lock arm 30 is formed substantially in the middle of the upper wall of the inner tubular portion 24. The lock arm 30 preferably is formed by two elongated cuts 29 that extend backward from the opening edge.

A locking claw 31 is provided at the front end of the lock arm 30 and can be engaged with the locking portion 17 of the female housing 10 when the housings 10, 20 are properly connected with each other. A tapered surface 32 is formed on the front-end surface of the locking claw 31, so that the lock arm 30 can move smoothly move over the tapered surface 15*b* substantially in the middle of the female housing 10. Further, a deformation permitting space S is formed above the lock arm 30 for permitting an elastic deformation of the lock arm 30.

Openings are made in the upper wall and the rear end wall of the male housing 20, as shown in FIG. 1, and the slider 40 is mountable between the main body 21 and the receptacle 22 through these openings. This slider 40 is provided with a spring holder 41, and two spring accommodating portions 42 are formed respectively at substantially opposite sides of the spring holder 41. Elastically deformable coil springs 43 are accommodated at least partly in the spring accommodating portions 42, and spring stoppers 44 are mounted securely on the front ends of the coil springs 43. A shorting terminal 60, described in detail later, is at least partly mountable on the slider 40 from behind. Each spring accommodating portion 42 is in the form of a substantially circular tube having an open front end. A wall surface 45 bulges out at a part of the front opening edge, and can be engaged with a part of the spring stopper 44 to prevent the coil spring 43 from coming out of the spring accommodating portion 42. Further, an escape groove 46 is formed in the bottom wall of each spring accommodating portion 42 over a specified length from the front end surface to allow the insertion of the corresponding pushing portion 12.

Guide projections 47 are provided on substantially opposite side surfaces of the spring holder 41. The movement of the slider 40 along forward/backward directions is guided by fitting the guide projections 47 in grooves 33 formed in the inner surfaces of the receptacle 22 along a longitudinal direction. Two projections 48 are provided respectively in positions on the opposite sides of the upper surface of the spring holder 41 near the front end. The projections 48 are slidable along flutes or grooves or notches or recesses 34 formed in the ceiling surface of the receptacle 22 along forward/backward directions as the slider 40 is moved forward and backward. A stopper 35 projects in an intermediate position of the flute 34, and a backward movement of the stopper 40 is prevented by the engagement of the projections 48 with the stoppers 35.

Two elastically deformable holding arms 49 are provided on the lower surface of the spring holder 41 and substantially on the same lines as the escape grooves 46. Additionally, locking claws 50 are formed at the front ends of the holding arms 49 and are engaged with the hooking recesses 28 of the main body 21 to prevent a backward movement of the slider 40. Tapered surfaces 51 are formed on the front-end surfaces of the locking claws 50 of the holding arms 49, so that the holding arms 49 can move smoothly over the tapered surfaces 15*a* of the female housing 10. The locking claws 50 and the hooking recesses 28 are disengaged at the same time or slightly before the housings 10, 20 are properly connected with each other.

An upper front end of the receptacle 22 hangs down to be partly connected with the opening edge of the inner tubular portion 24, thereby forming a front wall 36 which stops the front end of the slider 40. A middle portion of the front wall 36 that is aligned with the lock arm 30 is cut away, as shown in FIG. 3, for the sake of convenience. Additionally, openings 37 are formed on opposite sides of the cut-away portion for introducing the pushing portions 12 of the female housings 10 into the receptacle 22. The openings 37 are provided in positions substantially aligned with the escape grooves 46 of the spring holder 41. Accordingly, the pushing portions 12 engage the spring stoppers 44 to contract the coil springs 43 elastically while the housings 10, 20 are being connected with each other.

Figure 6:
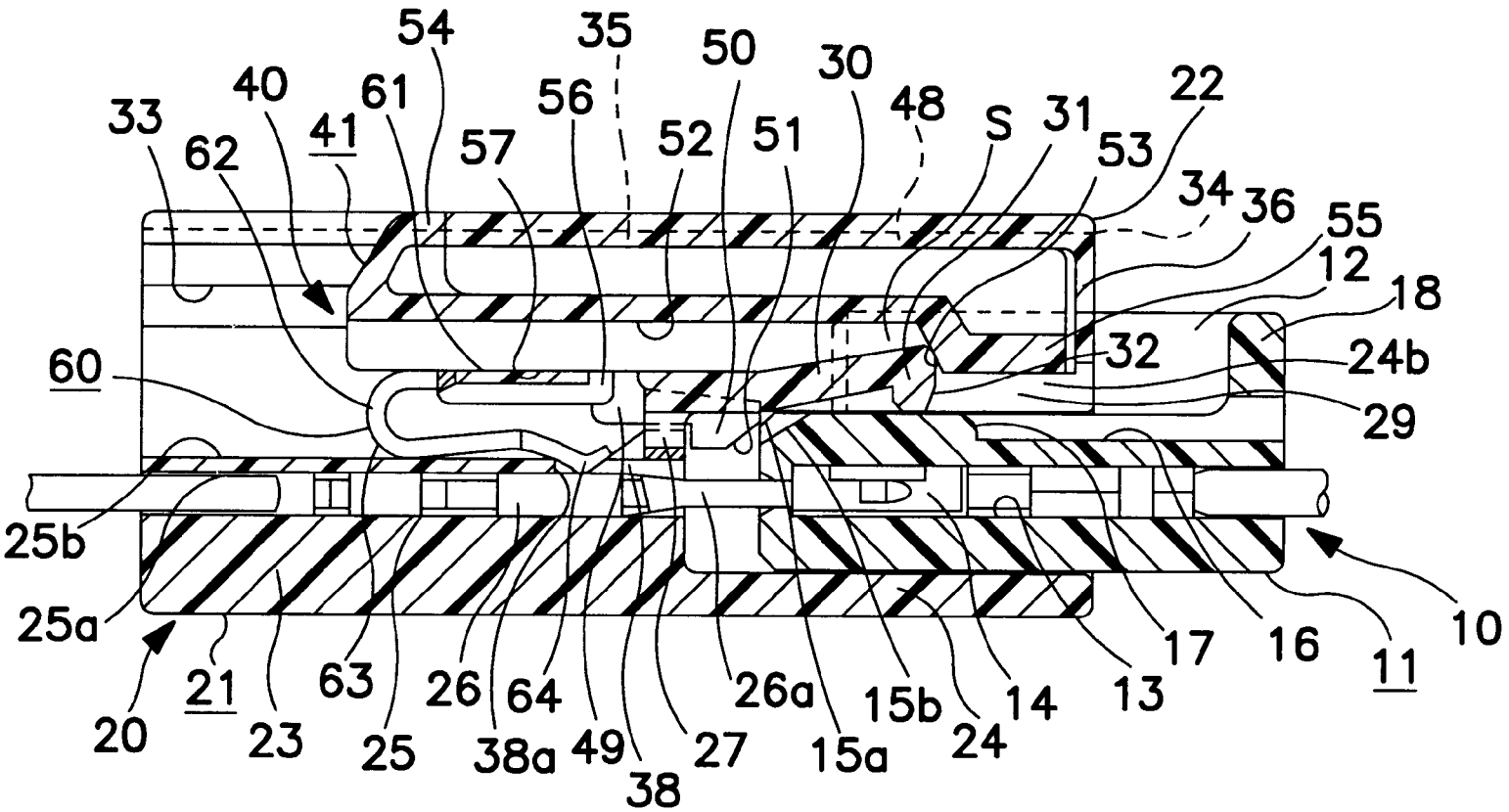
FIG. 6 is a cross-section view similar to FIG. 4, but showing the male and female housings while being connected.

A middle portion of the bottom surface of the spring holder 41 is located in the deformation permitting space S of the lock arm 30 as shown in FIG. 4, and an escape recess 52 is formed in this middle portion for allowing an upward elastic deformation of the lock arm 30. A front portion 55 of the spring holder 41 is formed before the escape recess 52, and can at least partly enter the deformation permitting space S as the slider 40 is moved backward. The front end of the escape recess 52 defines a locking surface 53 for preventing a backward movement of the slider 40. More particularly, as shown in FIG. 6, the locking surface 53 is held substantially in contact with the front end of the locking claw 31 when the lock arm 30 is elastically deformed upward during the connection of the housings 10, 20, thereby preventing backward movement of the slider 40. Locking by the locking claw 31 is cleared when the housings 10, 20 are completely connected with each other and the lock arm 30 is restored substantially to its original shape.

An upright operable portion 54 is formed substantially in a middle portion of the rear end of the spring holder 41. Further, a backward stroke of the spring holder 41 is set such that the rear end of the spring holder 41 does not project out from the male housing 20.

The main body 21 of the male connector housing 20 comprises a cutout or window 21a that allows a manipulation or operation of the slider 40 against the biasing force of the coil springs 43. Thus the slider 40 can be slid manually or automatically from its clearing position to its shorting position for releasing the female connector housing 10 from the receptacle 22 of the male connector housing 20. At this instance, the interaction of the spring stoppers 44 with the front portion of the pushing portion 12 creates a biasing force that pushes the female connector housing 10 out of connection with the male connector 20.

The locking claw 31 and/or the locking portion 17 comprise at least one slanted disengagement portion 32*a*/17*a* for assisting the disengagement of the locking claw 31 and the locking portion 17 when the slider 40 is pushed further into the male connector housing 20, thereby increasing the spring load of the coil springs 43. When the spring load of the springs 43 exceeds a predetermined strength or height, the locking claw 31 and the locking portion 17 are disengaged from each other by the assistance of the slanted disengagement portion 32*a* and/or 17*a*. The disengagement portion(s) 32*a*/17*a* also may be formed by rounding the corresponding portion of the locking claw 31 and/or locking portion 17.

A mount portion 56 is formed at a rear part of the lower surface of the spring holder 41, and extends over substantially the entire width of the spring holder 41. The mount portion 56 is used to mount the shorting terminal 60, as shown in FIGS. 1 and 4. A groove 57 with an open rear end is formed substantially in the middle of the mount portion 56.

The shorting terminal 60 is formed from an electrically conductive plate material, and includes a flat main body 61. The shorting terminal 60 is mounted integrally on the slider 40 by inserting the flat main body 61 thereof into the groove 57. Four (or a number corresponding to the number of respective terminal fittings 26) contact pieces 62 extend from the rear end surface of the main body 61, and are spaced from one another by distances that correspond to the spacing between the respective cavities 25 in the male housing 20. The contact pieces 62 are turned to extend along the lower surface of the main body 61 such that they extend slightly obliquely upward from bottom ends 63. Leading ends of the contact pieces 62 are formed narrower and have a substantially triangular cross section projecting downward. These projections serve as contacts 64. The contact pieces 62 are substantially elastically deformable, and the leading ends thereof formed with the contacts 64 have a width slightly smaller than the widths of the exposing portions 38 formed in the terminal-accommodating portion 23.

Figure 5:
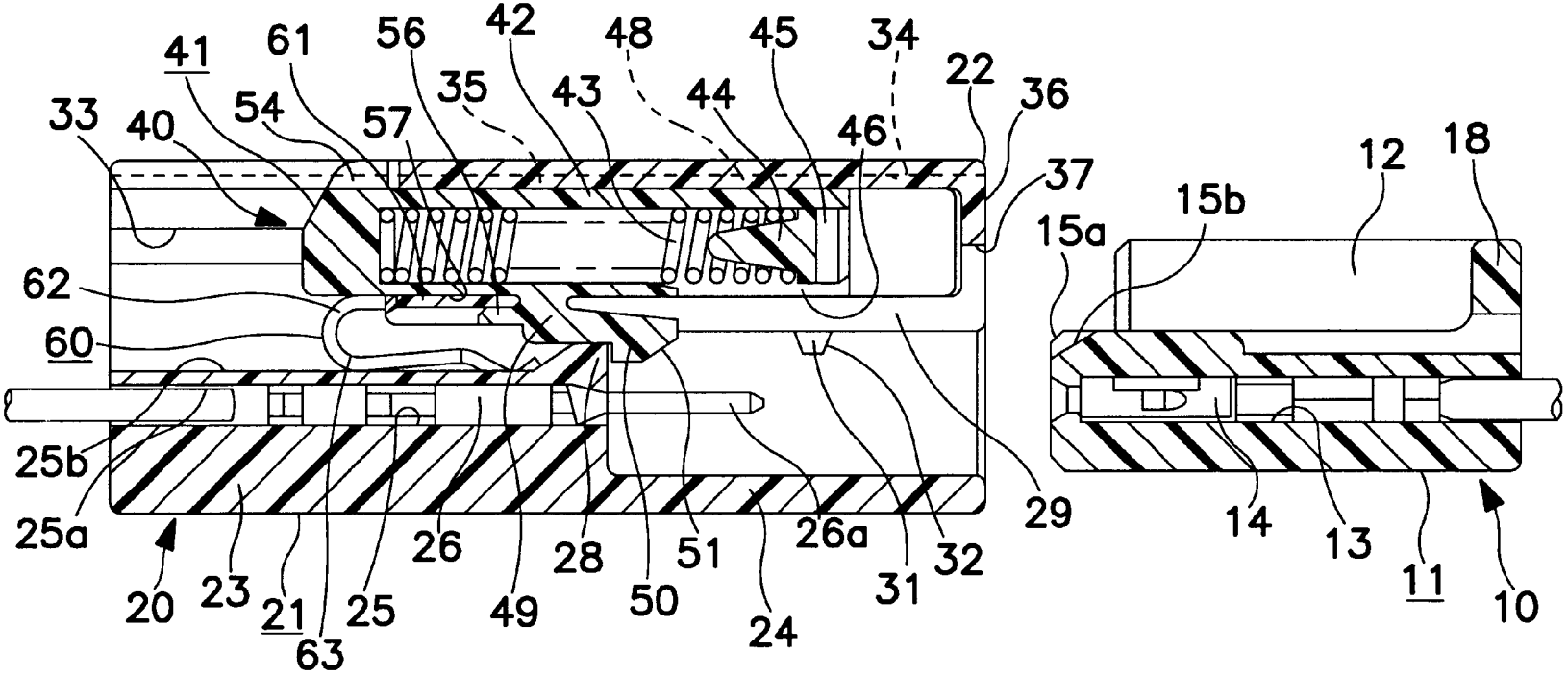
FIG. 5 is a section along line 5—5 of FIG. 3 showing the male and female housings before being connected.

The contacts 64 of the contact pieces 62 of the shorting terminal 60 enter the exposing portions 38 of the terminal-accommodating portion 23 when the slider 40 is in the position shown in FIGS. 4 and 5. As a result, the contacts 64 of the shorting terminal 60 contact the section of the male terminal fittings 26 that are exposed through the exposing portions 38, and thereby short the male terminal fittings 26 to each other. The position of the slider 40 at this stage is referred to as a shorting position. With the slider 40 moved to a position shown in FIGS. 8 and 9, the contacts 64 of the contact pieces 62 are held in contact with upper surfaces 25*b* of the surrounding walls 25*a* surrounding the cavities 25 to clear their contact with the male terminal fittings 26. The position of the slider 40 at this stage is referred to as a clearing position.

The female housing 10, as described above, can be inserted at least partly into the male housing 20 by sliding the bottom surface of the female housing 10 substantially along the inner surface of the bottom wall of the inner tubular portion 24 of the male housing 20 to connect the housings 10, 20. The slider 40 at this stage is located in its shorting position where the male terminal fittings 26 are shorted by the shorting terminal 60.

The tapered surface 32 of the lock arm 30 initially is brought into contact with the tapered surface 15*b* in the middle of the front end of the female housing 10. The lock arm 30 is guided by the tapered surface 15*b* as the housings 10, 20 are being connected, and the lock arm 30 is deformed elastically upward. As a result, the bottom end of the locking claw 31 is moved onto the upper surface of the female housing 10, as shown in FIG. 6. At this time, the lock arm 30 escapes into the escape recess 52 of the springing holder 41 located thereabove, and the front end of the locking claw 31 is engaged with the locking surface 53 of the escape recess 52. At an intermediate stage of the connection of the housings 10, 20, the slider 40 is prevented from moving backward by the lock arm 30 that has been deformed elastically upward and by the locking claws 50 of the holding arms 49.

Figure 7:
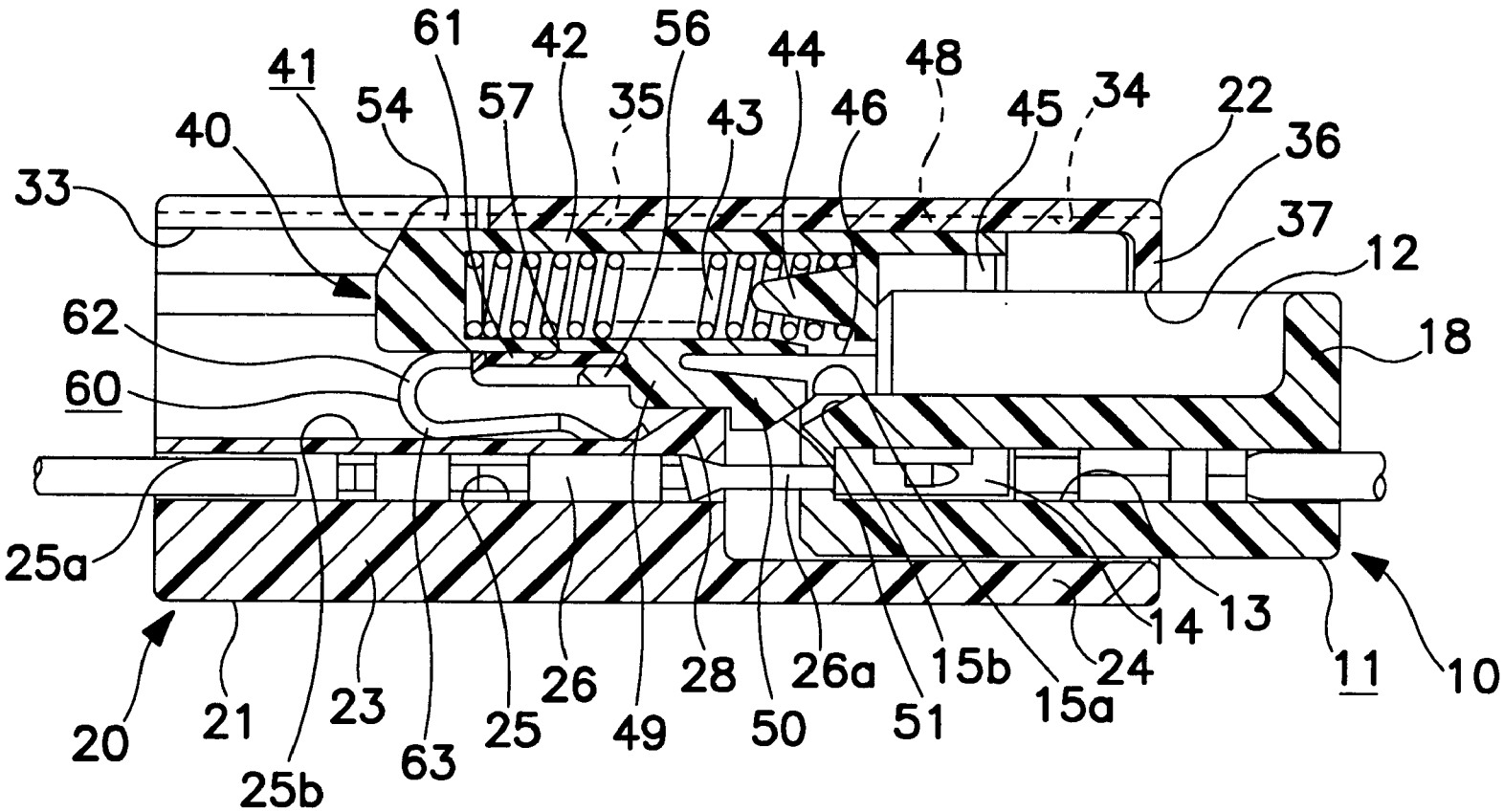
FIG. 7 is a cross-sectional view similar to FIG. 5, but showing the male and female housings while being connected.

As the connection of the housings 10, 20 proceeds, the pushing portions 12 of the female housing 10 enter the spring accommodating portions 42 through the openings 37 and the escape grooves 46. The pushing portions 12 then contact the spring stoppers 44 mounted on the front ends of the coil springs 43, as shown in FIG. 7. Further advancement of the pushing portions 12 toward the back of the spring accommodating portions 42 causes an elastic deformation of the coil springs 43. At this time, the slider 40 is doubly locked by the locking claws 50 of the holding arms 49 and by the locking claw 31 of the lock arm 30 so as not to move backward. If the connection is interrupted at this stage, the elastically deformed coil springs 43 are restored substantially to or towards their original shapes and the male housing 20 is repelled in a direction away from the female housing 10 due to the restoring forces of the coil springs 43. Therefore, the partial connection of the housings 10, 20 can be detected.

Figure 9:
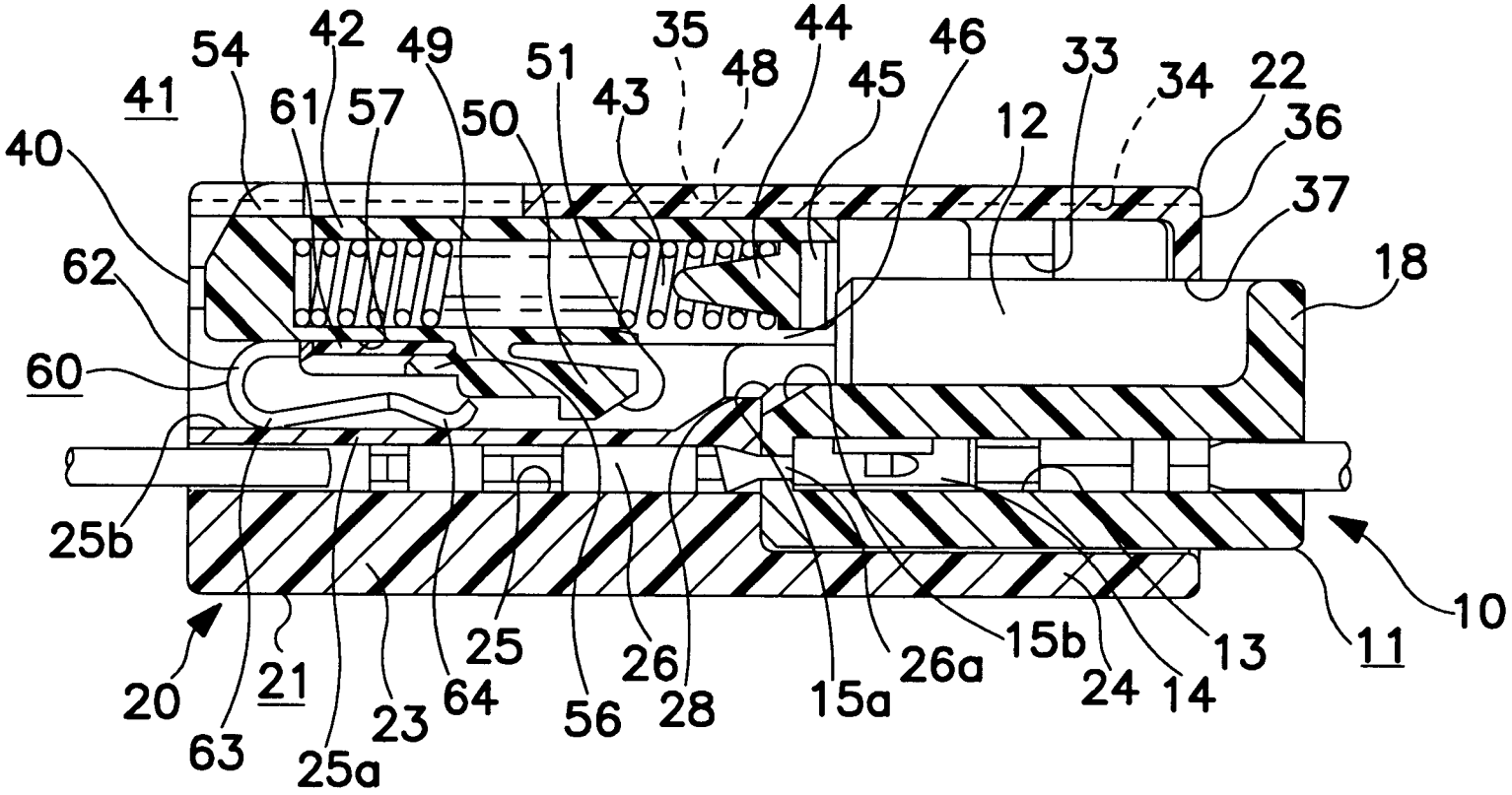
FIG. 9 is a cross-sectional view similar to FIGS. 5 and 7, but showing the male and female housings after being completely connected.
Figure 10:
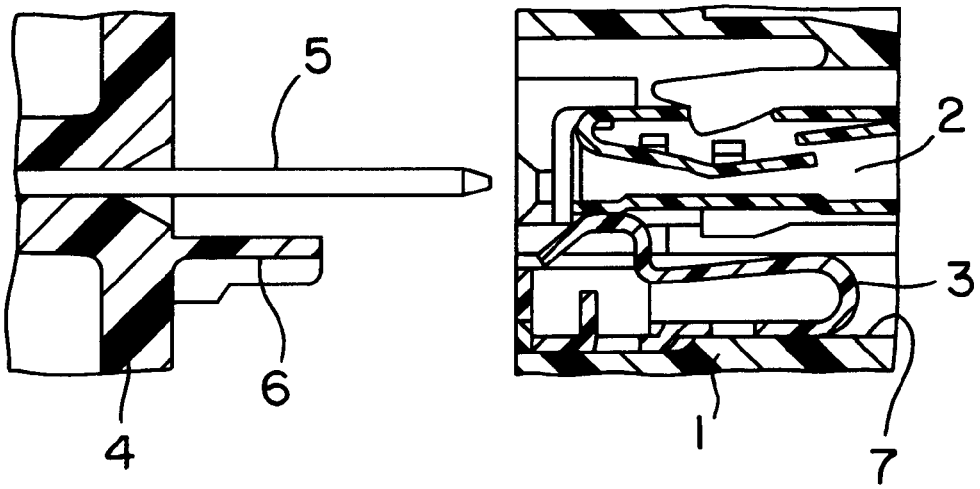
FIG. 10 PRIOR ART
FIG. 10 is a partial section of a prior art connector.

As the connection proceeds further to connect the housings 10, 20 properly, the tapered surfaces 15*a* of the female housing 10 are brought into contact with the tapered surfaces 51 of the holding arms 49. Consequently, the holding arms 49 are deformed elastically upward while being guided by the tapered surfaces 15*a*. The locking claws 50 are displaced upward as the holding arms 49 elastically deform, and are disengaged from the hooking recesses 28 after being raised to a specified height, as shown in FIG. 9.

Figure 8:
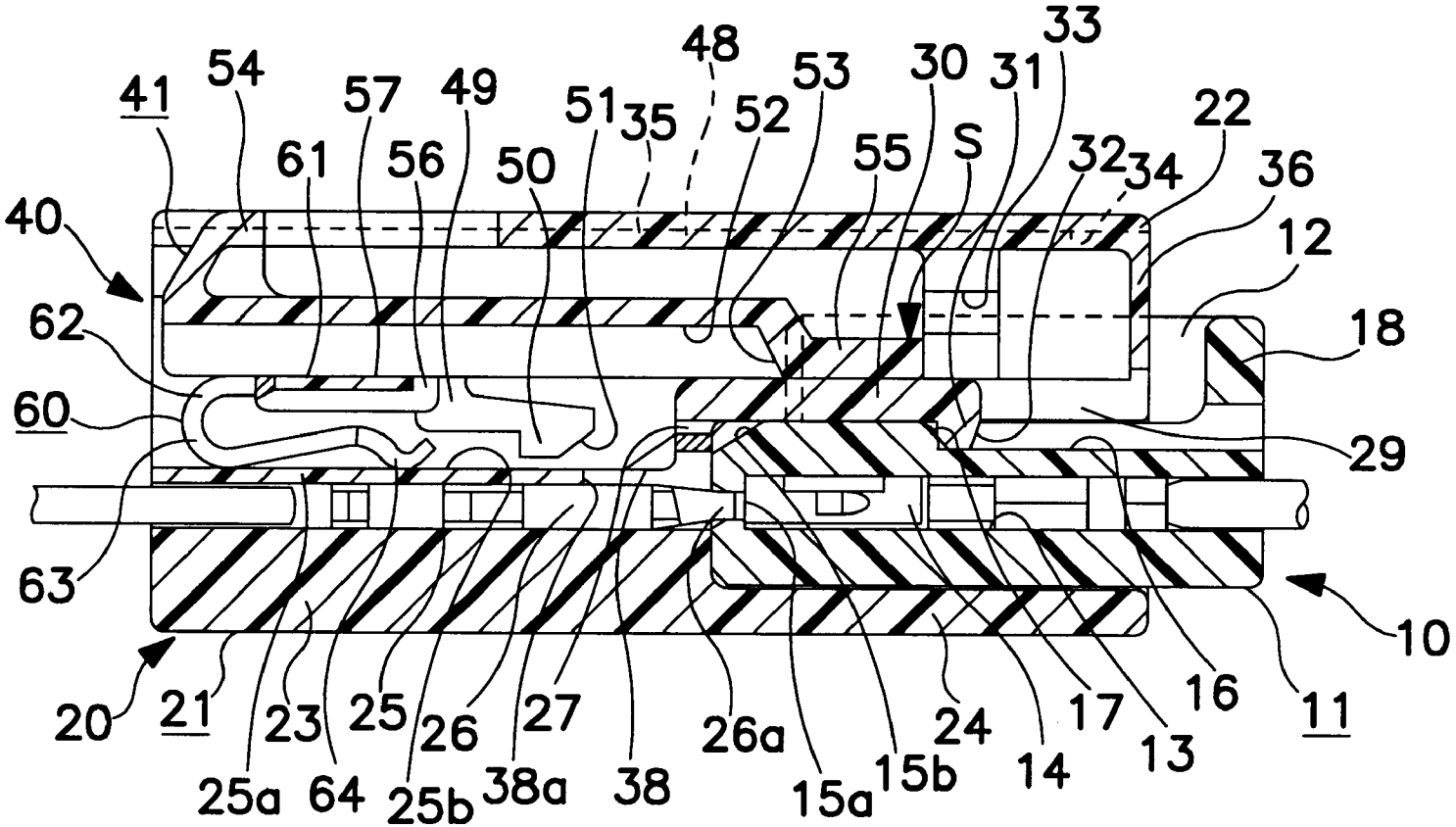
FIG. 8 is a cross-sectional view similar to FIGS. 4 and 6, but showing the male and female housings after being completely connected.

The lock arm 30 is restored elastically substantially to or towards its original shape substantially at the same time the holding arms 49 are disengaged to effect unlocking. Thus the lock arm 30 extends along the lower surface of the spring holder 41. As a result, the locking claw 31 of the lock arm 30 enters the recess 16 of the female housing 10 to engage the locking portion 17, and the front end of the lock arm 30 is disengaged from the locking surface 53 of the escape recess 52, as shown in FIG. 8. In this way, the double locking, that had been effected to prevent the slider 40 from moving backward, is cleared, and the slider 40 is moved backward by the elastic restoring forces of the coil springs 43. As the slider 40 is moved backward, the projections 48 on the upper surface of the spring holder 41 slide along the grooves 34. The movement of the slider 40 is stopped when the projections 48 contact the stoppers 35. This prevents any further backward movement of the slider 40.

As the slider 40 is moved backward, the contacts 64 of the contact pieces 62 of the shorting terminal 60, which were located in the exposing portions 38 of the terminal accommodating portion 23, are moved onto the tapered surfaces 38*a* at the rear edge of the exposing portions 38. As a result, the contact pieces 62 are deformed elastically. The contacts 64 are guided to the upper surfaces 25*b* of the surrounding walls 25*a* by the tapered surfaces 38*a*, and are slid backward along the upper surfaces 25*b*. When the movement of the slider 40 is stopped, the shorting terminal 60 is provided at the rear side of the terminal accommodating portion 23 and the contacts 64 of the respective contact pieces 62 are located on the upper surfaces 25*b* of the surrounding walls 25*a* completely insulated from the male terminal fittings 26. In this way, the slider 40 is moved automatically from its shorting position, where it can short the male terminal fittings 26, to the clearing position, where the shorted state is cleared.

Since the slider 40 is retracted and the front portion 55 in the middle of the spring holder 41 is located in the deformation permitting space S above the lock arm 30, the leading end of the lock arm 30 is pressed by the lower surface of the front portion 55. Thus, an upward elastic deformation of the lock arm 30 is restricted and the locking portion 17 is doubly locked, thereby holding the housings 10, 20 securely locked into each other with an enhanced force.

In this way, the backward displacement of the slider 40 indicates that the housings 10, 20 are substantially completely connected with each other and the terminal fittings 14, 26 are securely electrically connected with each other. Both coil springs 43 are returned to their natural lengths when no force is acting by the backward movement of the spring holder 41. Consequently, the coil springs 43 do not create any force to separate the completely connected housings 10, 20 from each other.

As described above the slider 40 in the male housing 20 is unlocked when the housings 10, 20 are connected properly with each other, and is moved backward automatically by the elastic restoring forces of the elastically contracted coil springs 43. By integrally mounting the shorting terminal 60 in this slider 40, the shorting terminal 60 can be moved automatically from the shorting position where the contacts 64 are held in shorting contact with the male terminal fittings 26 to the clearing position where the contacts 64 are not in contact with the male terminal fittings 26.

More specifically, the shorted state of the male terminal fittings 26 can be cleared by the movement of the slider 40. Hence it is not necessary to provide the mating female housing 10 with any rib for entering between the shorting terminal 60 and the male terminal fittings 26 to clear the shorted state, as had been the case in the prior art. The prior art clearing rib on the front end surface of female housing requires attention to be paid in packaging at a time of shipment since the rib is likely to be struck by an external force and broken. Further, since the height of the connector increases as the thickness of the clearing rib increases, the prior art clearing rib may be formed thin. However, such a thin clearing rib has caused molding errors in the prior art, thereby causing the undesirable event where the shorted state cannot be cleared. Therefore, an operation of checking for molding errors becomes necessary with the subject invention. In this embodiment, such a rib can be simplified or deleted.

The present invention is not limited to the above described and illustrated embodiment. For example, following embodiments are also embraced by the technical scope of the invention as defined in the claims. Besides these embodiments, various changes can be made without departing from the scope and spirit of the invention as defined in the claims.

Although the exposing portions 38 for allowing the contact of the shorting terminal 60 with the male terminal fittings 26 is provided in or at the terminal accommodating portion 23 in the foregoing embodiment, they may not be necessarily provided, if, for example, the shorting terminal is brought into contact with tabs of male terminal fittings projecting from the terminal accommodating portion.

In the foregoing embodiment, the locking claw 31 of the lock arm 30 which is substantially elastically deformed when the housings 10, 20 are partly connected is engaged with the locking surface 53 of the slider 40 (movable element) as the restricting means for the slider 40. Since the slider 40 is held also by the engagement of the holding arms 49 with the hooking recesses 28 of the male housing 20, the slider may not necessarily be formed with the lock arm.

What is claimed is:

1. A connector, comprising first and second connector housings at least partly connectable with each other, wherein the second connector housing comprises:

a plurality of terminal fittings;

a shorting terminal;

a movable element integrally engaged with the shorting terminal and being movable in the second connector housing between a shorting position where the shorting terminal is in shorting contact with the terminal fittings and a clearing position where the shorting terminal is not in contact with the terminal fittings;

a spring mounted in the second connector housing and engaged with the moveable element, the spring being elastically contracted to accumulate a biasing force for moving the moveable element toward the clearing position in response to pushing forces exerted by the first connector housing; and a restricting means provided in the second connector housing for holding the moveable element in the shorting position, the holding of the moveable element by the restricting means being cleared as the connector housings are connected with each other.

2. A connector according to claim 1, wherein the movable element is movable substantially along a connection direction of the connector housings.

3. A connector according to claim 1, wherein the first connector housing comprises a locking portion, the second connector housing comprises an elastically deformable lock arm for holding the connector housings locked into each other by engaging the locking portion provided in the first connector housing when the connector housings are connected with each other.

4. A connector according to claim 1, wherein the movable element is provided with an elastically deformable holding arm, the holding arm engaging an engaging portion on the first connector housing, when the movable element is positioned substantially in its shorting position, while being elastically deformed upon contact with a contact portion of the second connector housing, thereby being disengaged from the engaging portion.

5. A connector according to claim 1, wherein the movable element is automatically moved from its shorting position where the shorting terminal is shorting the terminal fittings to the clearing position where the shorting terminal is not in electrical contact with the terminal fittings as the connector housings are properly connected with each other.

6. A connector, comprising first and second connector housings at least partly connectable with each other, the first connector housing comprising a locking portion, the second connector housing comprising:

a plurality of terminal fittings;

a shorting terminal for shorting the terminal fittings, a shorted state of the terminal fittings being cleared when the connector housings are connected with each other;

a moveable element integrally engaged with the shorting terminal and being moveable in the second connector housing between a shorting position where the shorting terminal is in shorting contact with the terminal fittings and a clearing position where the shorting terminal is not in contact with the terminal fittings;

an elastically deformable lock arm for engaging the locking portion of the first connector housing when the connector housings are connected with each other, and thereby holding the connector housings locked to each other, the lock arm being configured for moving over the locking portion and for engaging and holding the movable element in the shorting position when the lock arm is elastically deformed, the lock arm further being configured for engaging the locking portion and disengaging from the movable element when the lock arm is restored substantially to its original shape as the connector housings are properly connected with each other.

7. A connector according to claim 6, wherein the movable element is provided with a spring which is elastically contracted to accumulate a biasing force for moving the movable element toward the clearing position upon being pushed by a pushing portion provided in the first connector housing.

8. A connector according to claim 6, wherein the second connector housing further comprises a restricting means for substantially constantly holding the movable element in the shorting position, the holding state being cleared as the connector housings are connected with each other.

9. A connector, comprising first and second connector housings at least partly connectable with each other, the first connector housing comprising a locking portion, the second connector housing comprising:

a plurality of terminal fittings;

a shorting terminal for shorting the terminal fittings, a shorted state of the terminal fittings being cleared when the connector housings are connected with each other;

a moveable element integrally engaged with the shorting terminal and being moveable in the second connector housing between a shorting position where the shorting terminal is in shorting contact with the terminal fittings and a clearing position where the shorting terminal is not in contact with the terminal fittings;

an elastically deformable lock arm for engaging the locking portion of the first connector housing when the connector housings are connected with each other, and thereby holding the connector housings locked to each other, the lock arm being deformable into a deformation permitting space and wherein the movable element is at least partly located in the deformation permitting space when the movable element is in its clearing position thereby restricting an elastic deformation of the lock arm.

10. A connector according to claim 9, wherein at least one of the lock arm and the locking portion is formed with at least one slanted disengagement portion for assisting the disengagement of the lock arm and the locking portion.

* * * * *